US008069864B2

(12) United States Patent
Chininis et al.

(10) Patent No.: US 8,069,864 B2
(45) Date of Patent: Dec. 6, 2011

(54) HAIR RETAINING CLIP WITH DEPLOYABLE HANDLES

(75) Inventors: Stephen Chininis, Norcross, GA (US); Jose Longoria, Miami, FL (US)

(73) Assignee: Goody Products, Inc., Atlanta, GA (US)

( * ) Notice: Subject to any disclaimer, the term of this patent is extended or adjusted under 35 U.S.C. 154(b) by 711 days.

(21) Appl. No.: 11/648,516

(22) Filed: Dec. 29, 2006

(65) Prior Publication Data

US 2008/0156342 A1 Jul. 3, 2008

(51) Int. Cl.
*A45D 8/20* (2006.01)

(52) U.S. Cl. ..... 132/277; 24/502

(58) Field of Classification Search ..... 132/273, 132/276, 277, 279, 283, 284; 24/3.11, 3.12, 24/494, 502, 508, 513, 67.3; D28/39, 40, D28/42

See application file for complete search history.

(56) References Cited

U.S. PATENT DOCUMENTS

| | | | | |
|---|---|---|---|---|
| 1,865,453 | A * | 7/1932 | Baltzley | 24/545 |
| 5,533,533 | A | 7/1996 | Shing | 132/279 |
| 5,642,740 | A * | 7/1997 | Chen | 132/277 |
| 5,735,296 | A | 4/1998 | Chen | 132/277 |
| 5,803,096 | A | 9/1998 | Lee | 132/277 |
| 5,946,778 | A * | 9/1999 | McGarity | 24/536 |
| 6,186,151 | B1 | 2/2001 | Newlin | 132/273 |
| D497,689 | S | 10/2004 | Winn et al. | D28/43 |
| 7,690,388 | B2 | 4/2010 | Rogers | |
| 2004/0226574 | A1 | 11/2004 | Winn et al. | 132/277 |
| 2007/0175002 | A1 * | 8/2007 | Joe | 24/67.5 |

* cited by examiner

*Primary Examiner* — Rachel Steitz

(74) *Attorney, Agent, or Firm* — Lempia Summerfield Katz LLC

(57) ABSTRACT

A hair retaining clip includes a first claw portion, and a second claw portion pivotally connected to the first claw portion. A primary hinge may provide the pivotal connection between the first claw portion and the second claw portion, aligned along a primary hinge axis. At least one deployable handle extends from one of the first claw portion and the second claw portion, and may be movable between a deployed configuration and a stowed configuration.

10 Claims, 6 Drawing Sheets

HAIR RETAINING CLIP WITH DEPLOYABLE HANDLES

TECHNICAL FIELD

The present disclosure relates generally to clips for retaining strands of hair, and more particularly, to claw-type hair retaining clips.

BACKGROUND OF THE DISCLOSURE

Claw clips have been developed for hair styling that grip the hair using a spring force. However, if the spring force is increased, the clip can become difficult to open. Accordingly, it is desirable to have relatively long lever arms provided by long handles, so that the clip can be easily opened by a user. One problem posed by such long handles is that they can be unsightly and therefore detract from the appearance of the clip. Another problem is that the lever arms can extend out far enough to cause the clip to bump up against objects such as, for example, a car headrest.

SUMMARY OF THE DISCLOSURE

In accordance with one aspect of the disclosure a claw clip for hair styling includes at least one deployable handle that is adapted to deploy for opening the clip and also to be placed in a stowed configuration, for example, when the deployable handle is not in use. The at least one deployable handle may be pivotally connected to one of the first claw portion and the second claw portion, and may pivot about a secondary hinge axis that is substantially parallel to the primary hinge axis. Alternatively, the at least one deployable handle may be pivotally connected to one of the first claw portion and the second claw portion along a secondary hinge axis that is substantially orthogonal to the plane of the at least one deployable handle.

In accordance with another aspect of the disclosure, a hair retaining clip includes a first claw portion, a second claw portion pivotally connected to the first claw portion, a primary hinge providing the pivotal connection between the first claw portion and the second claw portion, the primary hinge aligned along a primary hinge axis, a first deployable handle extending from the first claw portion, and a second deployable handle extending from the second claw portion. Each of the first deployable handle and the second deployable handle is movable between a deployed configuration and a stowed configuration.

By increasing the effective lever arm provided by the deployable handles, claw clips made in accordance with the disclosure may be opened easily by a user. By providing handles that can be placed in a stowed position a lower profile claw clip with better function is provided.

Figure 1:
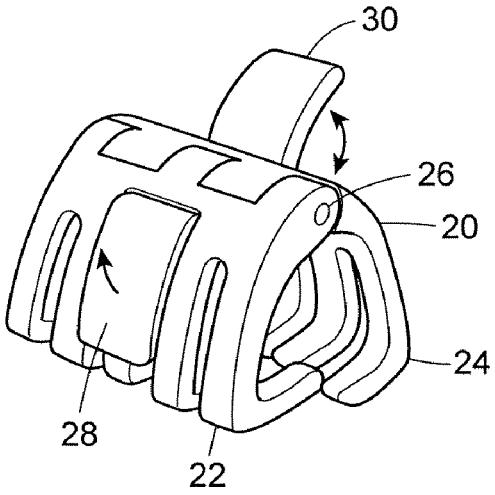
FIG. 1 is a diagrammatic perspective view of a hair retaining clip according to one embodiment of the disclosure, showing the hair retaining clip in a substantially closed configuration, with one deployable handle in a stowed position and another deployable handle in a deployed position.

While the method and device described herein are susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the disclosure and the appended claims.

DETAILED DESCRIPTION

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '————————' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 2:
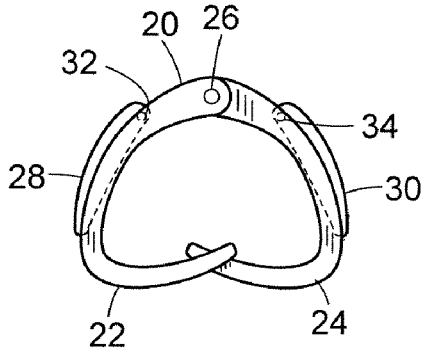
FIG. 2 is a side view of the hair retaining clip of FIG. 1, showing the hair retaining clip in a substantially closed configuration, with both of the deployable handles in the stowed position.
Figure 3:
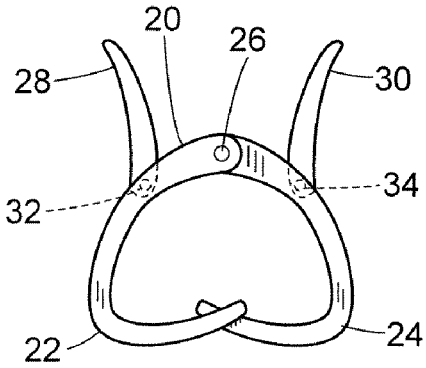
FIG. 3 is a side view, similar to that of FIG. 2, showing the hair retaining clip in a closed configuration, with both of the deployable handles in the deployed position.
Figure 4:
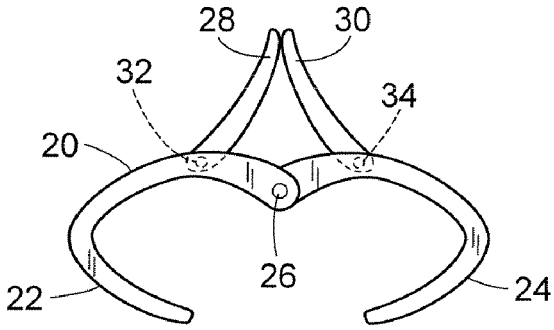
FIG. 4 is a side view similar to that of FIG. 2, showing the hair retaining clip in a substantially open configuration, with both of the deployable handles in the deployed position.

With reference initially to FIG. 1, a hair retaining clip 20 is shown with a first claw portion 22, that is pivotally attached to a second claw portion 24 via a primary hinge 26. The hair retaining clip 20 includes a first deployable handle 28, shown in a stowed position, and a second deployable handle 30, that is shown in a deployed position. As shown in FIGS. 2 through 4, the first deployable handle 28 may pivot about a first handle hinge 32, and the second deployable handle 30 may pivot about a second handle hinge 34. The first handle hinge 32 and the second handle hinge 34 may each have an axis of rotation that is substantially parallel to the axis of rotation of the primary hinge 26. The deployable handles 28 and 30 each include a pivot end and opposite thereto a free end. The pivot ends are pivotally coupled to the respective claw portions 22 and 24. And the free ends are free, that is, they are not coupled to each other or any other handle component. In the stowed configuration, the deployable handles 28 and 30 (in their entirety) are adjacent the respective claw portions 22 and 24 in a low-profile arrangement. And in the deployed configuration, the deployable handles 28 and 30 (in their entirety except for the pivot ends) extend away from the respective claw portions 22 and 24 in an opposing arrangement to provide increased effective lever so that the free ends can be pressed together to open the hair-retaining clip.

Thus, when a user desires to open the hair retaining clip 20, the user may flip up the first deployable handle 28 and the second deployable handle 30 into the deployed position, as shown in FIGS. 3 and 4. As shown in FIG. 2, the user may place the first deployable handle 28 and the second deployable handle 30 in a stowed position, for example, once the hair retaining clip 20 is in place in the user's hair (not shown).

Figure 5:
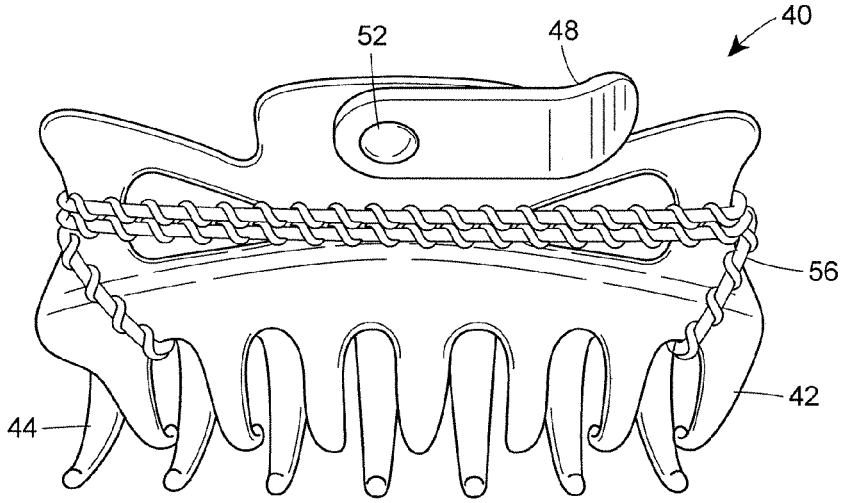
FIG. 5 is a front view of a hair retaining clip according to a second embodiment of the disclosure, showing a deployable handle in a stowed position.
Figure 6:
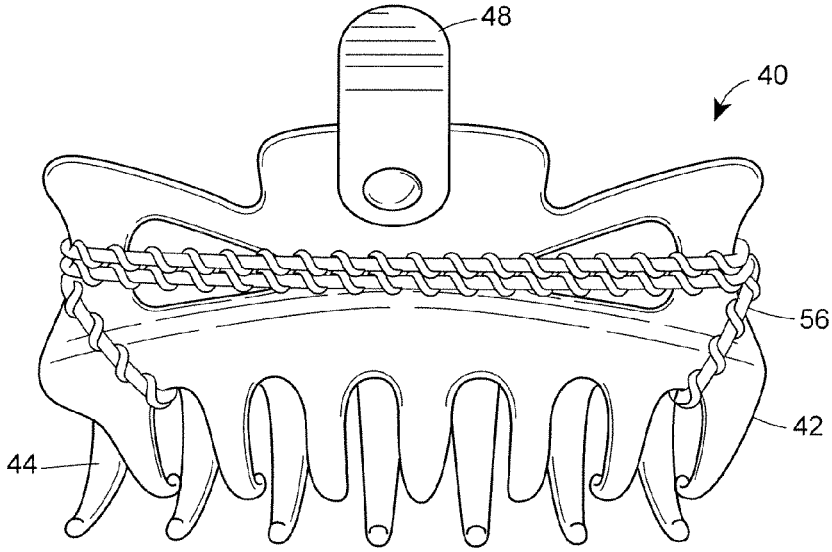
FIG. 6 is front view, similar to that of FIG. 5, showing the hair retaining clip of FIG. 5, showing the deployable handle in a deployed position.
Figure 7:
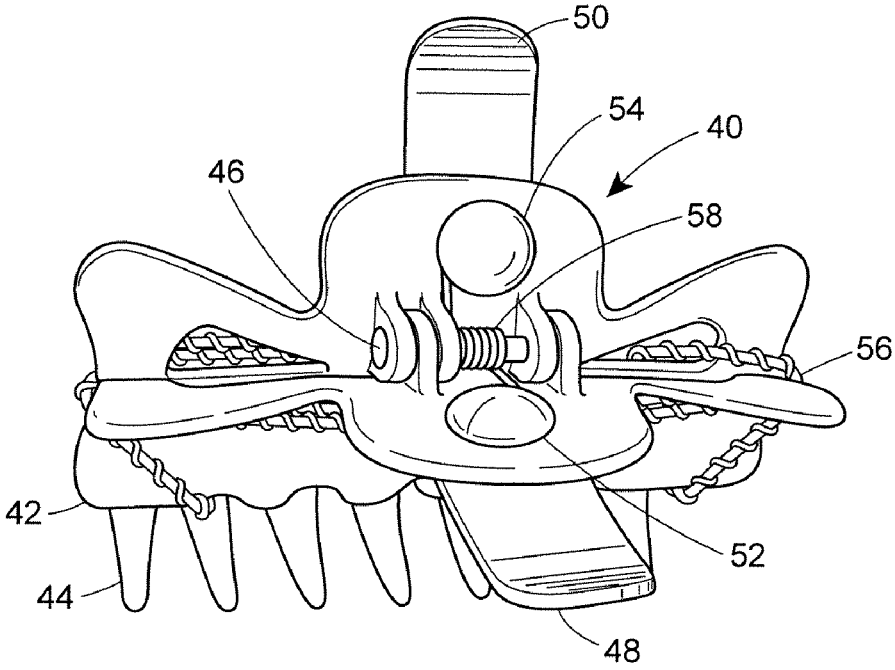
FIG. 7 is a perspective view from above showing the hair retaining clip of FIG. 5 in a closed configuration with the deployable handles in the deployed position.
Figure 8:
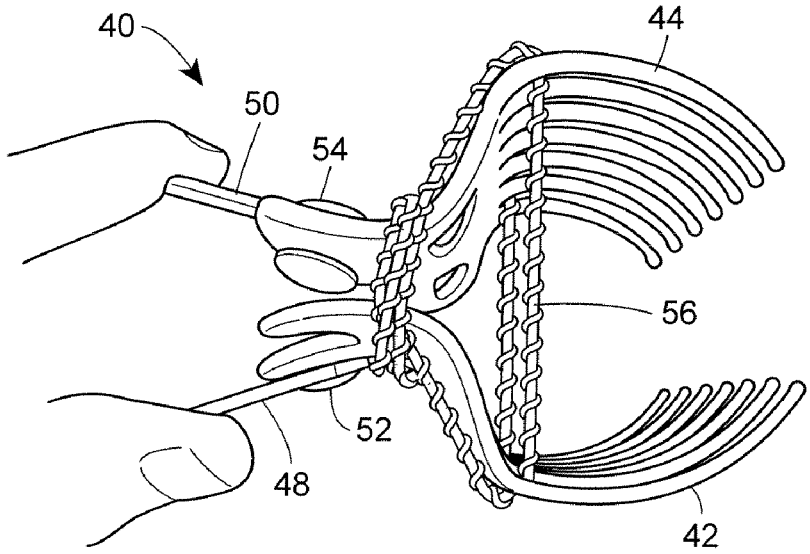
FIG. 8 is a side perspective diagrammatic view of the hair retaining clip of FIG. 5 in a substantially open configuration, showing the deployable handles in the deployed position, while being squeezed by the fingers of a user.

With reference to FIGS. 5 thru 8, a second embodiment of a hair retaining clip is generally indicated at 40. The hair retaining clip 40 includes a first claw portion 42 and a second claw portion 44, that are pivotally joined to one another via a primary hinge 46 (FIG. 7). The hair retaining clip 40 includes a first deployable handle 48, and a second deployable handle 50. The first deployable handle may pivot about a first handle pivot pin 52, and the second deployable handle 50 may pivot about a second handle pivot pin 54. The first handle pivot pin 52 may provide an axis of rotation that is substantially orthogonal to the plane of the first deployable handle 48, when the first deployable handle 48 is rotated between a stowed position, as shown in FIG. 5, and a deployed position, as shown in FIGS. 6 through 8. Similarly, the second handle pivot pin 54 may provide an axis of rotation that is substantially orthogonal to the plane of the second deployable handle 50, when the second deployable handle 50 is rotated between a stowed position and a deployed position. The hair retaining clip 40 may include an elastic member 56 and/or a coil spring 58 (FIG. 7), in order to bias the hair retaining clip 40 to a closed configuration.

With reference to FIGS. 9 through 12, a hair retaining clip 120 according to a third embodiment is shown with a first claw portion 122, that is pivotally attached to a second claw portion 124 via a living hinge 126. The hair retaining clip 120 includes a first deployable handle 128, shown in a stowed position in FIG. 12, and a second deployable handle 130, shown in a deployed position in FIG. 12. The first deployable handle 128 may pivot about a first handle hinge pin 132, and the second deployable handle 130 may pivot about a second handle hinge pin 134. The first handle hinge pin 132 and the second handle hinge pin 134 may each have an axis of rotation that is substantially parallel to the axis of rotation of the living hinge 126.

Figure 9:
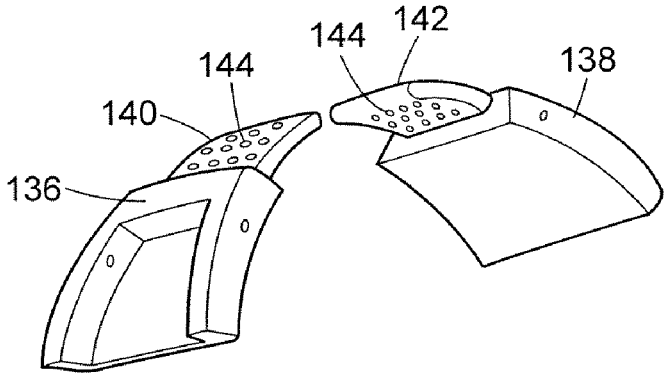
FIG. 9 is a perspective view of inner arm portions of a hair retaining clip according to a third embodiment of the disclosure.
Figure 10:
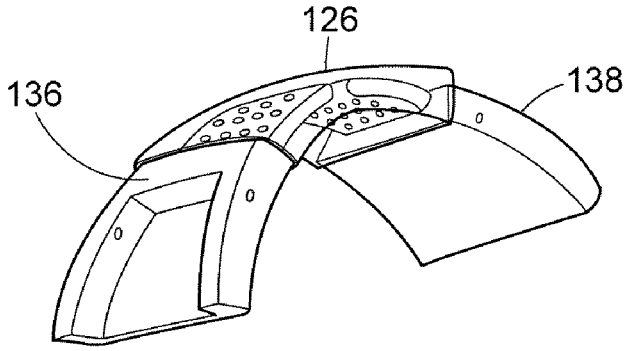
FIG. 10 is a perspective view of inner arm portions of FIG. 9 with a living hinge member joining the inner arm portions.

As seen in isolation in FIG. 9, the hair retaining clip 120 may include first and second inner arm portions 136 and 138, each having respective hinge attachment portions 140, 142 with a plurality of holes 144 therein. As shown in FIG. 10, the living hinge 126 may be over molded over the hinge attachment portions 140 and 142, and the holes 144 may serve to anchor the living hinge 126 to the hinge attachment portions 140 and 142. The living hinge 126 may be made from soft PVC material, and may be translucent, if desired.

Figure 11:
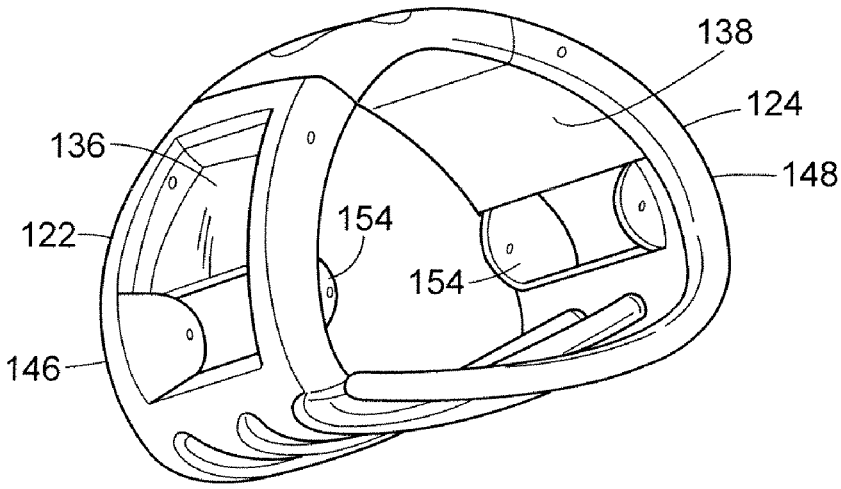
FIG. 11 is a perspective view of the inner arm portions and living hinge member of FIG. 10 secured to outer main body members.

FIG. 11 shows the inner arm portions 136 and 138 secured to first and second outer main body members 146 and 148 in order to form the first and second claw portions 122 and 124.

Figure 12:
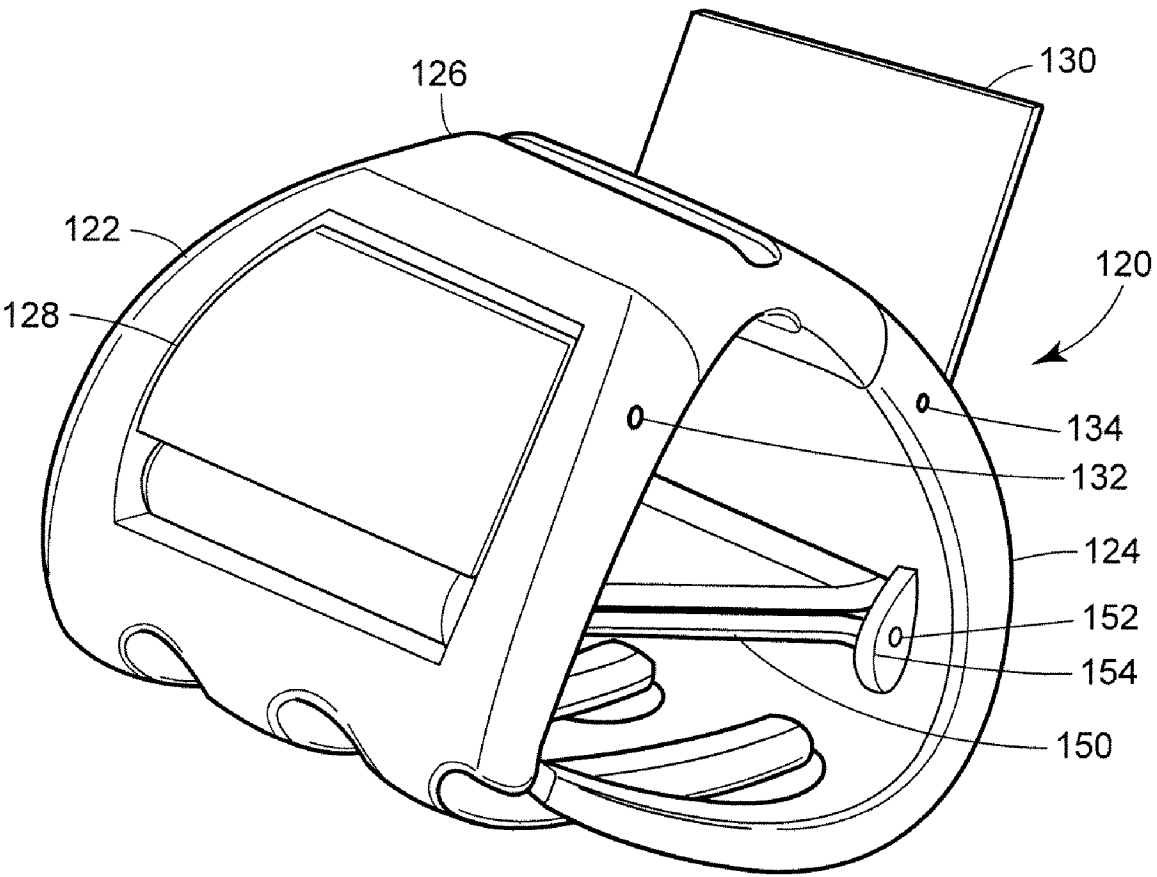
FIG. 12 is a perspective view of a fully assembled hair retaining clip according to the third embodiment of the disclosure.

FIG. 12 shows the hair retaining clip 120 in a fully-assembled configuration, with an elastic member 150 attached to the first and second claw portions 122 and 124 with pins 152 (only one of which is visible in FIG. 12) that mate with attachment lugs 154 on each of the first and second claw portions 122 and 124. The elastic member 150 serves to bias the hair retaining clip 120 toward a closed configuration so that it may securely grip a user's hair (not shown).

Figure 13:
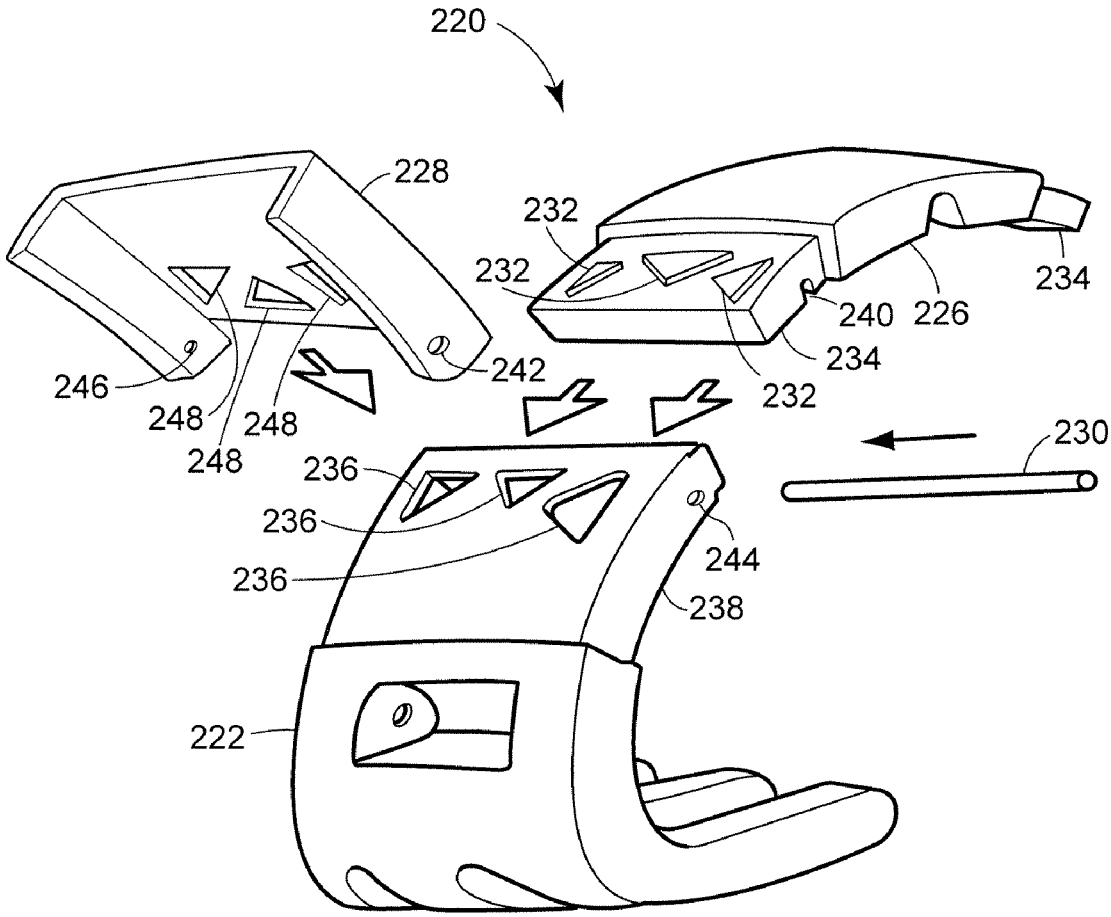
FIG. 13 is a perspective exploded view of portions of a hair retaining clip according to a fourth embodiment of the disclosure.

With reference to FIG. 13, portions of a hair retaining clip 220 according to a fourth embodiment, similar to that of the third embodiment, are shown. The hair retaining clip 220 includes two claw portions 222 (only one of which is shown), that are pivotally attached to one another via a living hinge 226. Each claw portion 222 may be pivotally attached to a deployable handle 228 via a handle hinge pin 230.

Raised portions 232 of an attachment tab 234 of the living hinge 226 may extend through corresponding openings 236 in the claw portion 222, when the attachment tab 234 of the living hinge 226 is inserted into a channel-shaped attachment portion 238 of the claw portion 222 in order to provide anchoring of the claw portion 222 to the living hinge 226. The handle hinge pin 230 may serve to further secure attachment of the claw portion 222 to the living hinge 226, by engaging a notch 240 extending across the underside of the attachment tab 234 of the living hinge 226 when the handle hinge pin 230 is inserted through a first opening 242 in the deployable handle 228, a first opening 244 in the claw portion 222, the notch 240 on the living hinge 226, a second opening (not shown) in the claw portion 222, and finally a second opening 246 in the deployable handle 228.

The raised portions 232 may also extend into corresponding indentations 248 in the underside of the deployable handle 228 in order to provide a soft latching of the deployable handle 228 to the claw portion 222 when the deployable handle 228 is in a stowed configuration.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A hair retaining clip comprising:

a first claw portion;

a second claw portion pivotally connected to the first claw portion;

a primary hinge providing the pivotal connection between the first claw portion and the second claw portion, the primary hinge aligned along a primary hinge axis; and at least one deployable handle having an entire length and extending from one of the first claw portion and the second claw portion, wherein the at least one deployable handle is movable between a deployed configuration and a stowed configuration, wherein the at least one deployable handle includes a coupling end and opposite thereto a free end, wherein the coupling end is coupled to one of the first claw portion and the second claw portion, wherein in the stowed configuration the entire length of the at least one deployable handle bears flat against the first or second claw portion in a low-profile arrangement so that the deployable handle does not extend from the claw portion, and in the deployed configuration the entire length of the at least one deployable handle, except for the coupling end, extends away from the first or second claw portion to provide an increased effective lever arm so that the free end can be depressed to open the hair-retaining clip, wherein the at least one deployable handle is pivotally connected to one of the first claw portion and the second claw portion.

2. The hair retaining clip of claim 1, wherein the at least one deployable handle is pivotally connected to one of the first claw portion and the second claw portion along a secondary hinge axis that is substantially parallel to the primary hinge axis.

3. The hair retaining clip of claim 1, wherein the at least one deployable handle is pivotally connected to one of the first claw portion and the second claw portion along a secondary hinge axis that is substantially orthogonal to the plane of the at least one deployable handle.

4. A hair retaining clip, comprising:

a first claw portion;

a second claw portion pivotally connected to the first claw portion;

a primary hinge providing the pivotal connection between the first claw portion and the second claw portion, the primary hinge aligned along a primary hinge axis;

a first deployable handle having a length and extending from the first claw portion, wherein the first deployable handle includes a coupling end and opposite thereto a free end, wherein the coupling end is coupled to the first claw portion; and a second deployable handle having a length and extending from the second claw portion, wherein the second deployable handle includes a coupling end and opposite thereto a free end, wherein the coupling end is coupled to the second claw portion;

wherein each of the first deployable handle and the second deployable handle is movable between a deployed configuration and a stowed configuration, wherein in the stowed configuration the first and second deployable handles are, over their lengths, partially nested within the first and second claw portions, respectively, in a low-profile arrangement so that the deployable handles do not extend from the claw portions, and in the deployed configuration the lengths of the first and second deployable handles, except for the coupling ends, extend away from the first and second claw portions, respectively, in an opposing arrangement to provide increased effective lever arms so that the free ends can be pressed toward each other to open the hair-retaining clip, wherein at least one of the first deployable handles and the second deployable handle is pivotally connected to one of the first claw portion and the second claw portion, respectively.

5. The hair retaining clip of claim 4, wherein the at least one deployable handle is pivotally connected to one of the first claw portion and the second claw portion along a secondary hinge axis that is substantially parallel to the primary hinge axis.

6. The hair retaining clip of claim 4, wherein the at least one deployable handle is pivotally connected to one of the first claw portion and the second claw portion along a secondary hinge axis that is substantially orthogonal to the plane of the at least one deployable handle.

7. The hair retaining clip of claim 4, wherein a hinge pin pivotally attaches the first deployable handle to the first claw portion.

8. The hair retaining clip of claim 7, wherein the hinge pin at least partially secures the first claw portion to the primary hinge.

9. The hair retaining clip of claim 7, wherein the primary hinge is a living hinge.

10. A hair retaining clip, comprising:

a first claw portion;

a second claw portion pivotally connected to the first claw portion;

a primary hinge providing the pivotal connection between the first claw portion and the second claw portion, the primary hinge aligned along a primary hinge axis;

a first deployable handle having a length and extending from the first claw portion, wherein the first deployable handle includes a coupling end and opposite thereto a free end, wherein the coupling end is coupled to the first claw portion; and a second deployable handle having a length and extending from the second claw portion, wherein the second deployable handle includes a coupling end and opposite thereto a free end, wherein the coupling end is coupled to the second claw portion;

wherein each of the first deployable handle and the second deployable handle is movable between a deployed configuration and a stowed configuration, wherein in the stowed configuration the first and second deployable handles are, over their lengths, partially nested within the first and second claw portions, respectively, in a low-profile arrangement so that the deployable handles do not extend from the claw portions, and in the deployed configuration the lengths of the first and second deployable handles, except for the coupling ends, extend away from the first and second claw portions, respectively, in an opposing arrangement to provide increased effective lever arms so that the free ends can be pressed toward each other to open the hair-retaining clip, wherein a hinge pin pivotally attaches the first deployable handle to the first claw portion.

* * * * *